US008438671B2

(12) United States Patent
Last

(10) Patent No.: US 8,438,671 B2
(45) Date of Patent: May 14, 2013

(54) AUTOMATED POOL-DECK LID LIFT SYSTEM FOR BELOW DECK POOL COVER HOUSING TROUGHS

(76) Inventor: Harry J. Last, Kailua, HI (US)

( * ) Notice: Subject to any disclaimer, the term of this patent is extended or adjusted under 35 U.S.C. 154(b) by 169 days.

(21) Appl. No.: 13/120,645

(22) PCT Filed: Dec. 8, 2009

(86) PCT No.: PCT/US2009/067224

§ 371 (c)(1),
(2), (4) Date: Mar. 23, 2011

(87) PCT Pub. No.: WO2010/077695

PCT Pub. Date: Jul. 8, 2010

(65) Prior Publication Data

US 2011/0167553 A1 Jul. 14, 2011

Related U.S. Application Data

(60) Provisional application No. 61/120,822, filed on Dec. 8, 2008.

(51) Int. Cl.
*E04H 4/00* (2006.01)

(52) U.S. Cl.
USPC ..... 4/500; 4/502

(58) Field of Classification Search ..... 4/498, 500, 4/502, 506; 242/390.5, 394
See application file for complete search history.

(56) References Cited

U.S. PATENT DOCUMENTS

| | | | | |
|---|---|---|---|---|
| 2002/0046817 | A1* | 4/2002 | Last | 160/133 |
| 2002/0073486 | A1* | 6/2002 | Bertoni | 4/502 |
| 2003/0084502 | A1* | 5/2003 | Epple et al. | 4/502 |
| 2006/0059614 | A1* | 3/2006 | Bouiss | 4/502 |
| 2006/0070377 | A1* | 4/2006 | Last | 60/475 |

* cited by examiner

*Primary Examiner* — Gregory Huson
*Assistant Examiner* — Janie Christiansen
(74) *Attorney, Agent, or Firm* — David E. Newhouse, Esq.

(57) ABSTRACT

The present invention relates to a system for sequentially supporting, opening and closing a pool-deck lid covering below-deck troughs housing coordinated with the operation of powered pool cover systems housed in the troughs. In certain embodiments the system comprises in combination: a front, longitudinal seating structure, an upwardly movably, cantilever bracket structure, hydraulic/pneumatic means, and a hydraulic/pneumatic actuation control means.

9 Claims, 11 Drawing Sheets

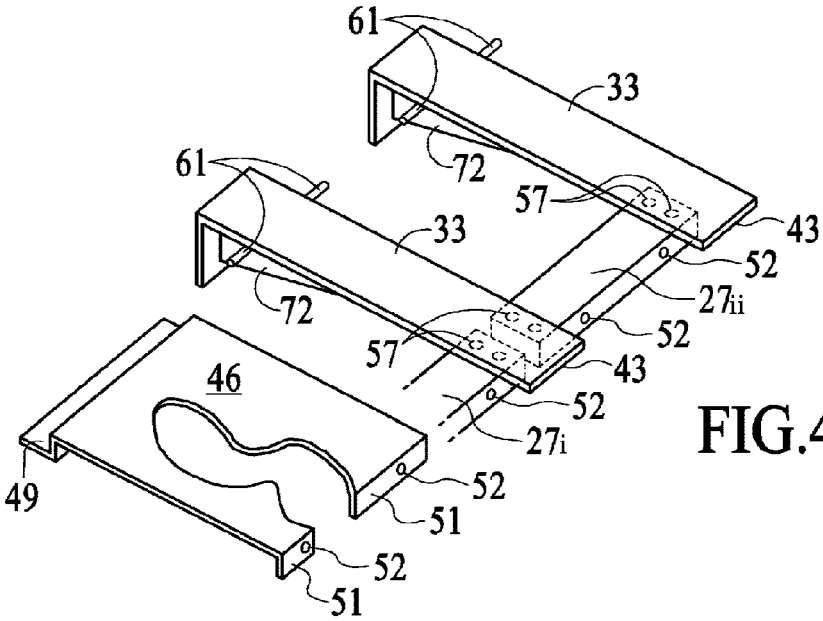
FIG.4a
FIG.4b
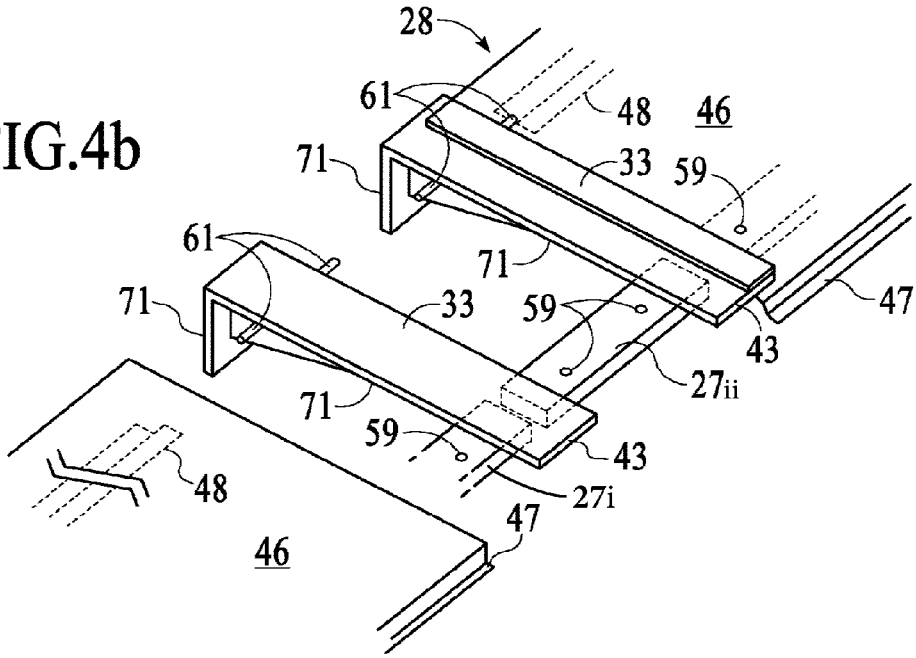

AUTOMATED POOL-DECK LID LIFT SYSTEM FOR BELOW DECK POOL COVER HOUSING TROUGHS

RELATED APPLICATIONS

This Application claims all benefits applicable under 35 U.S.C. §119(e) related to U.S. Provisional Patent Application Ser. No. 61/120,822 filed on behalf of the Applicant on 8 Dec. 2008 entitled "AUTOMATED HINGED LID FOR POOL COVER RECESS", and incorporates U.S. Provisional Patent Application Ser. No. 61/120,822 in its entirety herein by reference.

BACKGROUND OF THE INVENTION

1. Field of the Invention

The invention relates generally to automatic swimming pool cover systems, and, in particular to a system for sequentially supporting, opening and closing a pool-deck lid covering below-deck troughs housing with the operation of powered pool cover systems.

2. Description of the Prior Art

Swimming pools integrated with pool cover systems extending and retracting covers across the pool surface are safer, energy efficient, less expensive and easier to maintain. Pool covers also prevent heat and water loss through evaporation. It is also desirable to curtail other water losses from pools where water is scarce.

Water splashing over into below-deck troughs housing pool cover systems is primary source water loss from so equipped swimming pools. In particular, the bond beam topping the pool wall between the pool and trough housing are necessarily lower than the surrounding pool deck to allow retraction and extension of pool covers anchored by pool cover tracks secured in or along adjacent pool side walls. [See For example U.S. Pat. No. 5,913,613, Ragsdale; U.S. Pat. No. 6,446,276, Mathis; U.S. Pat. No. 6,496,990, Last; & U.S. Pat. No. 6,769,141, Epple et al.]

Below-deck troughs housing pool cover systems adjacent a sidewall of a swimming pool also present structural and design problems affecting access to the pool. In particular the housing troughs require pool deck lid structures that integrate with the deck surrounding the pool, that are capable of supporting people sitting on, standing on and diving into the pool, and that allow unencumbered, safe human ingress and egress to and from the pool. The deck lid structures also must allow repair access to the pool cover machinery housed in the trough. Skilled pool designers also recognize that pool wide slots/openings that accommodate the extending and retracting components of pool covers traveling crossing back and forth across the pool from below deck housing troughs detract from pool aesthetics, and present tripping hazards to swimmers accessing and exiting the pool. Accordingly, pool designs have evolved that integrate the leading edge structure carrying the front of the pool cover back and forth over the pool, with the trough housing pool walls, and the trough housing deck lid where the leading edge structure of the pool cover system essentially covers, and/or conceals the pool wide slots/openings when the pool cover is fully retracted. [See U.S. Pat. No. 6,886,188, Epple et al.]

Below-deck troughs housing pool cover systems necessarily encumber accessing and exiting vanishing edge pools. To explain, infinite or vanishing edge pools typically present a below-deck or lowered poolside that allows pool water to flow over into a capturing outside wall gutter below line-of-sight from the opposite side of the pool. Accordingly, the lowered pool edge seemingly extends infinitely or vanishes into the landscape, especially waterscape backgrounds. The housing trough for a pool cover system must be installed adjacent one of the remaining pool walls s affecting access and exit to and from the pool via the remaining pool walls.

Typical housing trough, deck lid structures include braces secured to structural back walls of the housing troughs with support arms cantilevered across the troughs for supporting modular lid plates/trays that in turn integrate, in appearance, with deck top and coping surfaces on, and topping the pool walls. The pool cover deploys to and from the housing trough via the pool wide openings or slots through the pool wall below the deck lid and above a lowered bond beam topping the pool wall between the pool and housing trough. Repair access to the housing trough is accomplished by lifting the modular lid plates/trays off pairs off the supporting cantilever support arms. [See U.S. Pat. Nos. 7,318,243 & 7,011,782, Smith; U.S. Pat. Nos. 6,886,188, & 6,769,141 Epple et al; and U.S. Pat. Nos. 6,862,756 & 6,446,276, Mathis.]

Another approach described in U.S. Patent Application No. 2006/0059614, Bouiss, (2006), provides repair access by rotating a housing trough lid to a vertical position supported on a longitudinal axle spanning the length of the trough supported at the ends by the housing trough walls and medially by one or more axle supports standing on the trough bottom. A plurality of spar ribs perpendicularly extend from the longitudinal axle that in turn support one or more longitudinal deck lid plates that span across the length and width of the housing trough.

In either case, the free, extending ends of cantilever support arms/spars, whether supported by an axle, or structurally secured at the back wall of housing troughs, tend bend or flex downward, responsive to load (weight) supported. In particular, the weight of modular deck lid structures and any people standing/sitting on any modular deck-lid, cause supporting pair(s) of cantilever braces/spars to bend/flex downward. In short, cantilever arm braces/spars alone are 'springy', and do not provide static (unmoving or static) support to deck-lid structures covering below-deck troughs housing pool covers systems adjacent sidewalls of swimming pools.

An approach attempting to provide static support to cantilevered structures extending over below-deck troughs housing pool cover systems along sidewalls of swimming pools is described in UK Patent GB 2370760 B, Jeffery et al, issued 26 May 2004, that teaches supporting distal flat or planiform poolside ends of a plurality cantilever structures extending across a housing trough with a vertically translatable, longitudinal I-beam, hydraulically raised or jacked-up, adjacent the wall between the trough and the pool. In Jeffery, the pool cover is clamped between the flat extending cantilevered planiform poolside ends of the deck-lid structure and the top surface of the longitudinal beam structure when it is hydraulically raised to the support position. Jeffery et al also proposes water saving membrane secured between the top of the upwardly translating beam and the wall top between the housing trough and pool for containing water pool, i.e., to prevent pool water from splashing into the housing trough when the cover is fully retracted, wound up in the housing trough. In Jeffery, the cantilever structures are joined with the surrounding deck of the pool.

The Jeffery solution presents more problems than it solves. First the beam raised by the hydraulic jacks must squarely engage simultaneously across the entire length of the poolside planiform structures cantilevered over the housing trough to preclude risk of fracture of the overlying deck. Also, objects/debris on top of the pool cover trapped in the entry slot to the trough housing between the rising support beam and one or more of the cantilevered structures precludes square engagement again creating a risk of fracture of the overlying deck and coping elements above the trapped debris. Next, the cantilevered structure and the supported pool deck also must be sufficiently rigid to support the pool deck without the raised beam, yet have sufficient flexibility and strength to allow for loading of the rising beam at its end points without risk of fracturing the overlying pool deck at the junctures of the pool deck and coping elements cantilevered over the pool cover housing. Third, the scheme does not fail safe, i.e., static support under the structures cantilevered over the trough housing fails upon loss of hydraulic support in one or more of the supporting jacks.

Finally, Applicant in his U.S. Pat. No. 6,938,415 issued Sep. 6, 2005 and U.S. Pat. No. 7,204,291 issued Apr. 17, 2007 respectively describe hydraulic/pneumatic actuation systems, and hydraulically actuated modular lid structures for covering housing troughs located below bottom pool surfaces housing buoyant-slat pool cover systems. In U.S. Pat. No. 6,938,415, the Applicant describes a hydraulic/pneumatic actuation system having a forward/extension cycle for sequentially opening a pool bottom lid covering the housing trough below the pool bottom, then resisting/driving rotation of a cover drum unwinding a buoyant-slat cover from the housing trough to cover a pool, and shutting off. In the reverse or retraction cycle, the hydraulic/pneumatic actuation system sequentially drives rotation of a cover drum in the pool bottom trough retracting the buoyant-slat cover from the pool surface completely winding it up around the cover drum, then allows the pool bottom trough lid to close responsive to gravity that shuts the system off upon lid closure. In U.S. Pat. No. 7,204,291 the Applicant describes a modular pool bottom lid structure for covering a housing trough below the pool bottom adapted to be opened and closed by hydraulically actuated systems.

SUMMARY OF THE INVENTION

A pool deck-lid lift system for below-deck troughs housing pool cover systems for pools features:

(i) a front longitudinal seating structure adapted to seat, for support, upon a static, below-deck, structured top of a pool sidewall between the pool and housing trough sandwiching traveling pool cover system elements that are extended and retracted back and forth across the pool;

(ii) a cantilever bracket structure movably secured along a back wall of the housing trough with a first plurality of extending support arms extending across the trough for supporting the front, poolside longitudinal lid seating structure and removable, modular deck-lid plates, and with a second plurality of actuator arms extending downward into the housing trough all secured at their distal or bottom ends to a common longitudinal box beam;

(iii) hydraulic/pneumatic means mechanically coupled to the common longitudinal box beam for lifting/pivoting the cantilever bracket structure, raising the front longitudinal seating structure off the lowered bond beam structure of the pool sidewall allowing extension and retraction travel of the traveling pool cover system elements back and forth across the pool; and (iv) a hydraulic/pneumatic actuation control means energizing the, deck-lid lift system and the pool cover system housed in the below-deck housing trough, coupled for sequentially:

a. lifting engagement of the front, poolside, longitudinal seating structure seated on the lowered bond beam structure of the pool sidewall, then b. energizing the automatic pool cover system for extending and retracting the pool cover out and/or in from across the pool; then c. stopping extension and retraction travel of the pool cover between, and at extension, retraction end points, and d. allowing the front, poolside, longitudinal seating structure supported by the cantilever bracket structure of the deck-lid system to re-seat upon the lowered bond beam structure of a pool sidewall between the pool and housing trough after travel of the pool cover is stopped.

BRIEF DESCRIPTION OF THE DRAWINGS

FIGS. 4*a*, 4*b*, 5*a* & 5*b*, are sketches illustrating different features of the modular deck-lid top plates supported between pairs of the extending support arms of the cantilever bracket structure and the structural features of the front, poolside, longitudinal seating structure fastened to the distal ends of the extending support arms.

FIG. 7(*a*) illustrates a stop block fastened to the traveling leading edge beam of the pool cover system for positively stopping pool cover retraction upon contact against the base section of the bond-beam of the adjacent pool wall between the pool and housing trough.

DESCRIPTION OF PREFERRED AND EXEMPLARY EMBODIMENTS

Figure 1A:
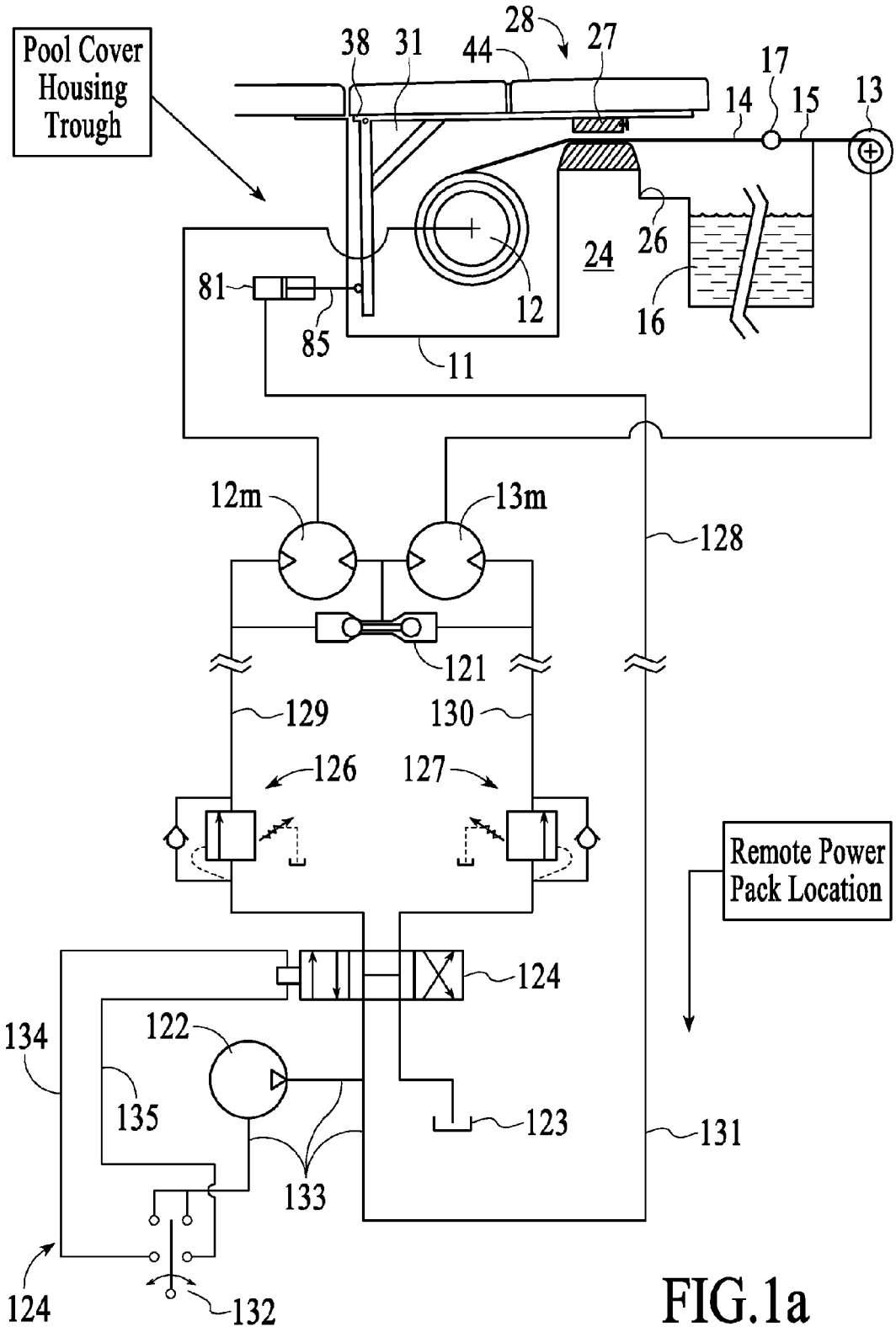
FIGS. 1*a*, 1*b*, 1*c* & 1*d* are schematic sketches illustrating the elements of the deck-lid lift system for covering below-deck troughs housing pool cover systems and exemplary hydraulic and/or pneumatic actuation control schemes for synchronizing raising and closing the deck-lid lift system with operation of hydraulically actuated pool cover systems.
Figure 1B:
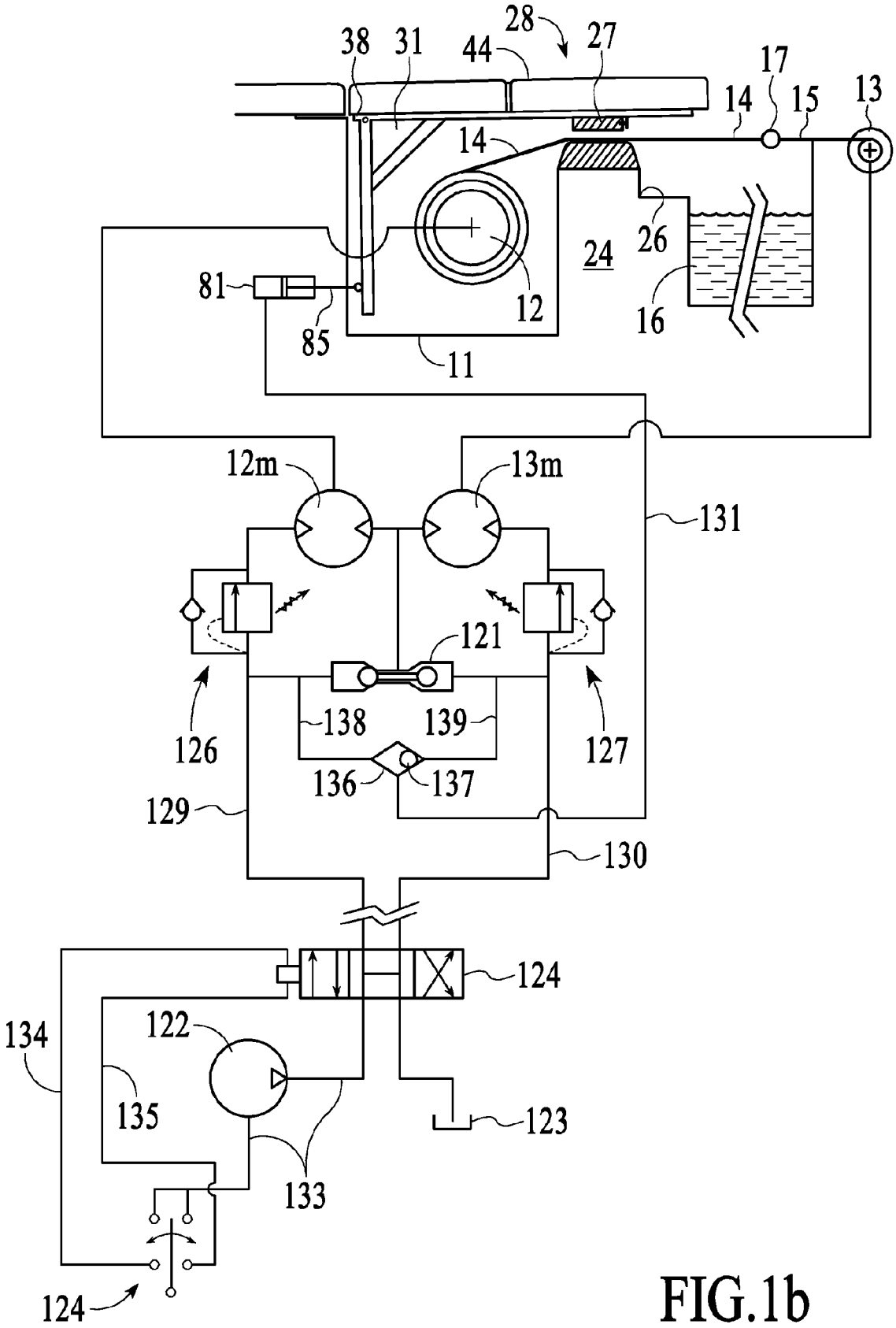
Figure 1C:
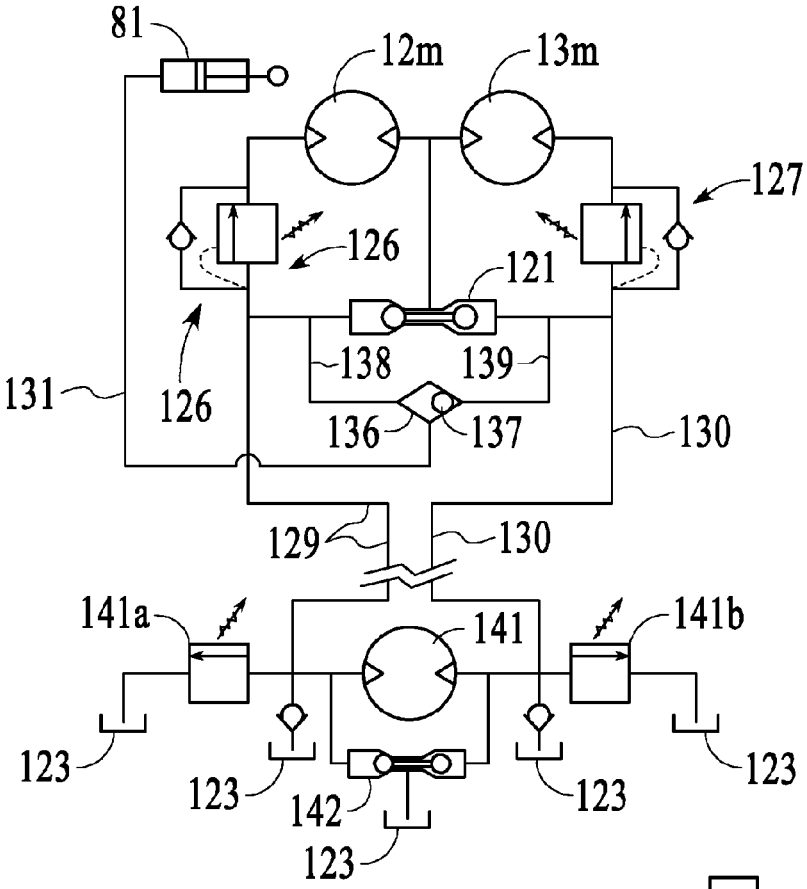
Figure 1D:
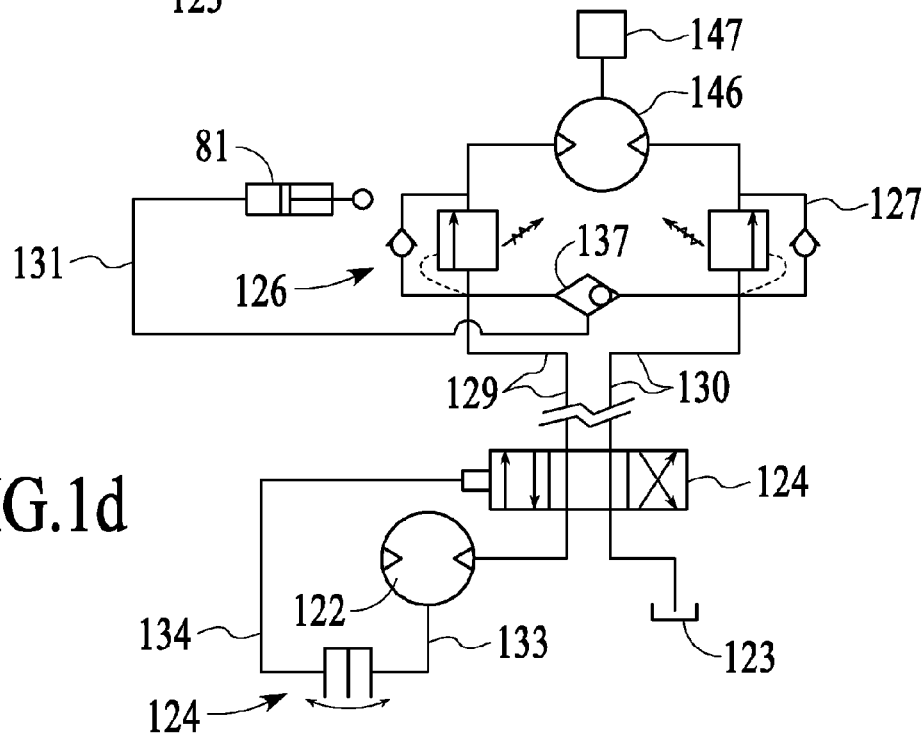

For context, and a clearer understanding of the features of Applicant's Automated Pool-Deck Lid Lift System for Below Deck Pool Cover Housing Troughs, refer to Applicant's U.S. Pat. No. 4,939,798 issued Jul. 10, 1990 describing a Leading Edge and Track Slider System for an Automatic Swimming Pool Cover; U.S. Pat. Nos. 5,184,357 & 5,327,590 respectively issued Feb. 2, 1993 and Jul. 12, 1994 describing Automatic Swimming Pool Covers With Dual Hydraulic Drive Systems; U.S. Pat. No. 6,496,990, issued Dec. 24, 2002 describing an Extruded Track Construct Component System for Swimming Pool Cover Systems; U.S. Pat. No. 6,938,415, issued Sep. 6, 2005 describing an Hydraulic/Pneumatic Apparatus; U.S. Pat. No. 6,827,120, issued Dec. 7, 2004 describing an Automatic Pool Cover System Using Buoyant Slat Pool Covers; U.S. Pat. No. 7,155,910 issued Jan. 2, 2007 describing a Dual, Coupled Check Valve for Direct, Reversible Power Sources for Hydraulic Systems, and U.S. Pat. No. 7,204,291 issued Apr. 17, 2007 describing a Modular Lid and Actuator for Underwater Pool Cover Drum Enclosure. Also see Applicant's published U.S. Patent Applications Nos. US2004/01443896 describing a Traveling Cover Bench System With Hydraulic Fluid Actuator (abandoned), and US2008/0178587 describing an Anti-Cavitation Manifold for Drive Coupled, Dual Motor, Reversible Hydraulic Drive Winding and Unwinding Systems. Each of the above cited patents and publications directly relate to the patentability of Applicant's Automated Pool-Deck Lid Lift System for Below Deck Pool Cover Housing Troughs described and claimed below. Accordingly each of the patents and publications cited above are incorporated herein as though fully set forth at length at this point.

In more detail, as schematically illustrated in cross-section in FIGS. 1*a*, 1*b*, 7, 8, and 9, Applicant's Automated Pool-Deck Lid Lift System for Below Deck Pool Cover Housing Troughs includes a below-deck trough 11 housing a hydraulically powered, reversibly rotatable, cover drum 12, for winding and unwinding a pool cover 14, a hydraulically powered, reversibly rotatable cable reel(s) 13 winding and unwinding cabling 15 coupling between the pool cover 14 and cable reels 13 that extend and retract the pool cover 14 back and forth across a pool 16. A leading-edge beam 17 (See FIGS. 7, 8, 9 & 10) spans between the pool sidewalls 18 above the pool surface supported by sliders 19 traveling in conventional pool cover tracks 21 mounted within or adjacent the pool sidewalls 18 that capture and support beaded side edges (not shown) of the pool cover 14 above the pool surface (See FIG. 10). A C-channel back edge 22 of the leading edge beam 17 captures and supports a front beaded edge 23 of the pool cover 14 above the of the pool 16 as the leading edge beam 17 and the pool cover 18 travels back and forth across, covering and uncovering the pool 16. The housing trough 11 is located along a below-deck end wall 24 of the pool 16. The top 26 of the end wall 24 is structured for receiving, seating and statically supporting a front longitudinal seating structure(s) 27 of the pool-deck lid 28 covering the housing trough 11.

In, more detail, looking at FIGS. 2, 3, 4, 4*b*, 5, 5*b*, 5*c*, 6, 11 & 12, the pool-deck lid 28 comprises a combination of an upwardly movably, preferably a pivotable mounted, approximately 90° angled cantilever bracket structure 31 secured along the longitudinal back wall 32 of the housing trough 11 having a plurality of extending support arms 33 each mechanically coupled to a corresponding vertical actuator arm 34, and a longitudinal actuator, box beam 36 mechanically fastened proximate the distal ends 37 of each vertical actuator arm 34. Each vertical actuator arm 34 of the cantilever bracket structure 31 is mechanically coupled with a hinge pin assembly 38 at its top end 39 that in-turn is securely anchored at the top the back wall 32 of the housing trough 11 preferably in a recess cut into the top surface of the back wall 32 beneath the pool deck 41.

Alternatively, each vertical actuator arm 34 of the cantilever bracket structure 31 may be movably secured and supported on a downwardly extending, inclined track structures 42 fastened at the top the back wall 32 of the trough 11, and statically supported on the trough bottom.

The front longitudinal seating structure(s) 27 of the pool-deck lid 28 are mechanically fastened proximate to, and hanging from the extending distal ends 43 of the plurality of extending support arms 33 of the cantilever structure 31. Removable modular deck-lid top plates 44 are statically supported on top of, and, at least, between each pair of the extending support arms 33. The modular deck-lid top plates 44 comprise a bottom ¼" steel plate 46 spanning between at least two of the extending support arms 33 and extending from the back wall 32 of the trough over and just beyond the front longitudinal seating structure 27 having a depending, front L-lip 47 that both stiffens the front edge of the plate 46 and supports coping material integrating the poolside edge of the pool-deck lid 28 with the above water sides of the pool 16. (See FIGS. 4*b*, 5*b*, & 5*c*.) The steel plates 46 may be further stiffened against bowing flexure between the extending support arms 33 by a Z-bar clip 48 and one or more L-angle bars 50 welded across the bottom face of the plate as shown in FIG. 5*c*.

Figure 5A:
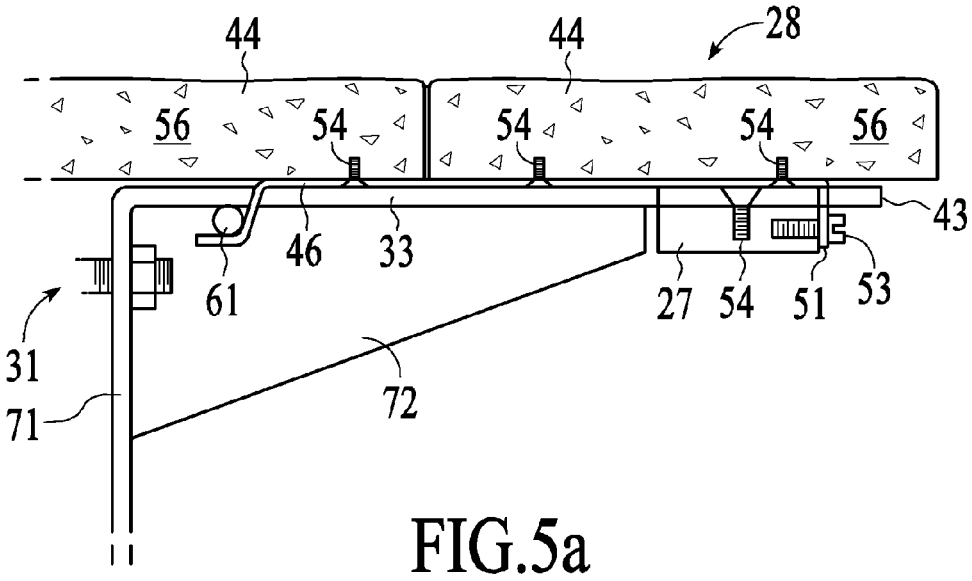

As shown in FIGS. 4 & 5 the steel plates 46 have depending, rear edge L-lips 49 and depending front lips 51 for stiffening the plates 46 against bowing flexure between the extending support arms 33. The depending front lips 51 include mounting holes 52, enabling the plate 46 to be held in place with screws or equivalent fasteners 53 to depending, front seating structures 27 of the pool-deck lid 28 fastened at the distal ends 43 of the extending support arms 33. Conventional flat head bolt/fasteners 54 also secure thick deck, coping stones/materials 56 to the steel plates 46 via conical holes 56 drilled into and through their bottom faces. Similarly, the front seating structure(s) 27 can be correspondingly secured to the distal end 43, underside of each pair of extending support arms 33 by conventional flat head bolt/fasteners 54 via conical holes drill into and through the top surfaces of the distal ends 43.

Figure 5B:
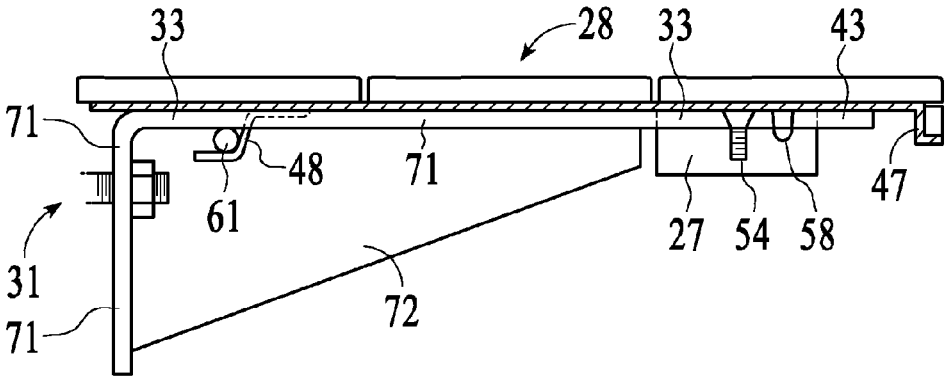

In the embodiment illustrated in FIGS. 4*b* & 5*b*, where the pool deck 41 surrounding the pool 16 has a thin finish surface material (tile, slate, or wood) holding pins 58 may welded to the bottom surface of the steel plates 46 located to register and drop into locator holes 59 drilled in to the top surface of the front longitudinal seating structure 27 between each pair of extending support arms 33. For holding the modular deck-lid top in place, i.e., from sliding transversely toward or away from the pool 16.

Figure 5C:
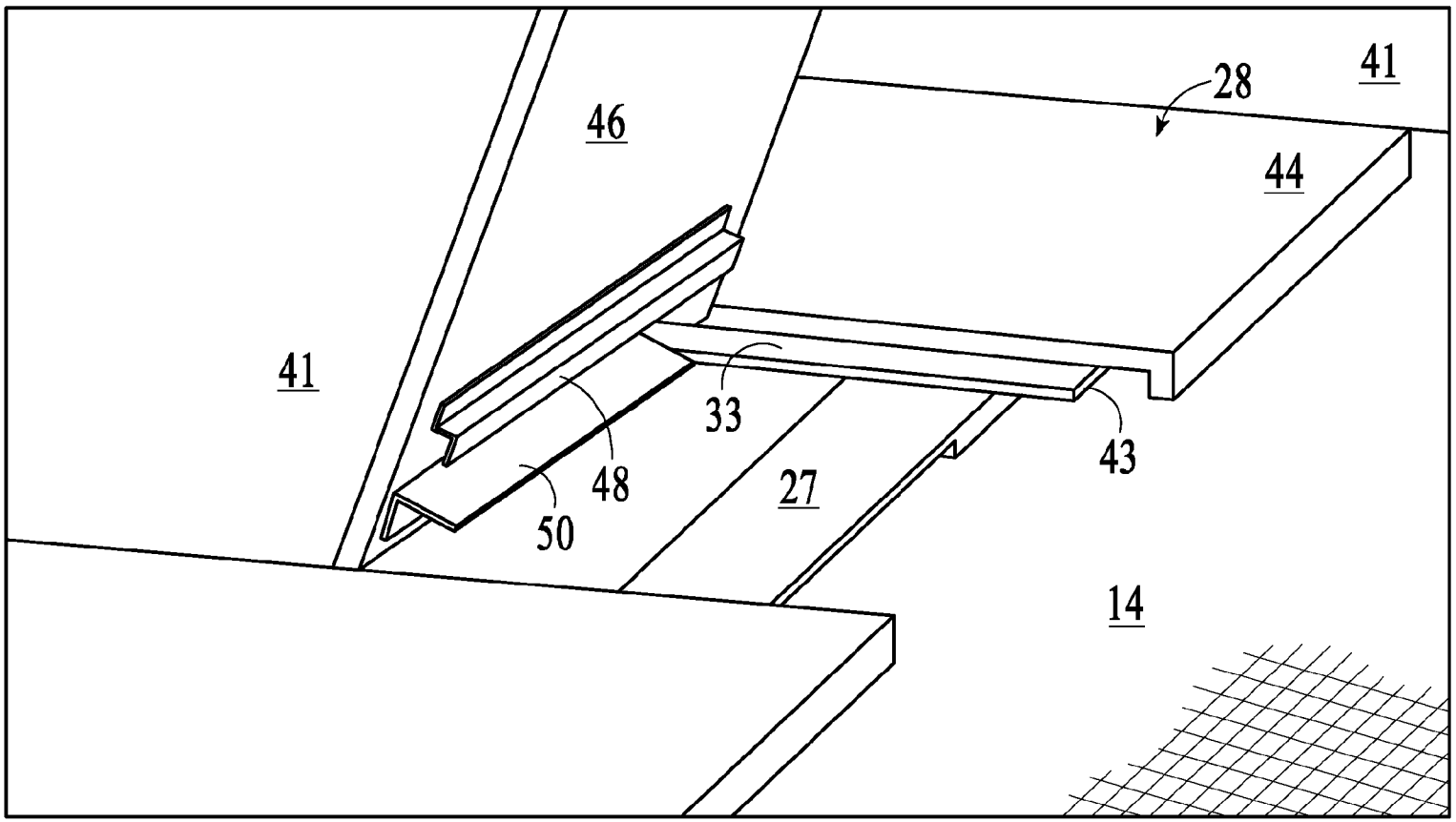
FIG. 5*c* is an image depicting the underside of the modular deck-lid top plates.

The steel plate 46, rear edge L-lips 49 of the modular deck-lid top plate 44 shown in FIGS. 4 & 5 and the Z-bar clip 48 of the modular deck-lid top plate 44 shown in FIGS. 4*b*, 5*b*, & 5*c* are adapted and located for capturing latch pins 61 extending out from each side of each extending support arm 33 are welded or otherwise secured to each support arm 33, between midpoint and the back end of the support arm 33. Maintenance access to the trough housing 11, the front longitudinal seating structure 27 and the structured top surface 26 of the pool end wall 24 is afforded by simply lifting the front edge of one or more of the modular deck-lid top plates 44 (after removal of screws/fasteners 53, if any (FIG. 5 vs. FIG. 5*b*) tilting/pivoting the particular modular deck-lid top plate on the latch pins 61 captured respectively by either the depending rear edge L-lip 49 of the steel plate of FIGS. 4 & 5 or by the welded Z-bar clip 48 welded across the bottom surface of the steel plate 46 of FIG. 5*c*. If necessary the modular deck-lid top plates 44 can be moved off of the cantilever bracket 31, and the mechanical couple between respective extending support arms 33 and corresponding vertical actuator arms can be uncoupled and removed as needed to gain greater access to the cover drum 12, the cable reels 13, the pool cover 14 and other components of the pool cover system housed in the below-deck housing trough 11, e.g., cabling, pulleys, and hydraulic lines, manifolds, motors and actuators.

Figure 2:
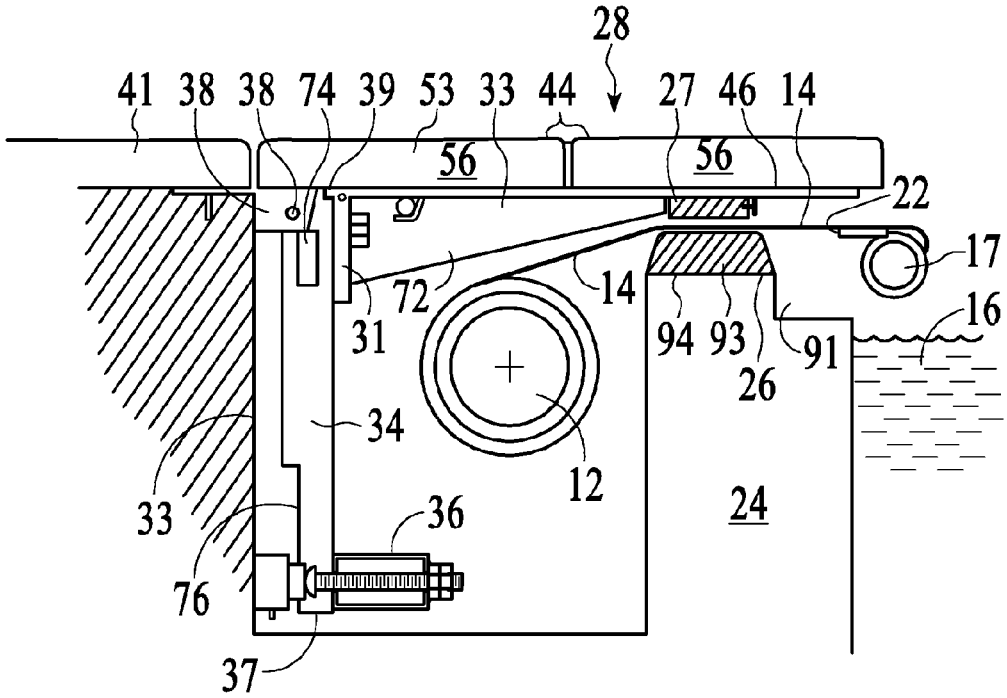
FIG. 2 is a sketch presenting a cross sectional view of the invented hinged, deck-lid lift system.
Figure 3:
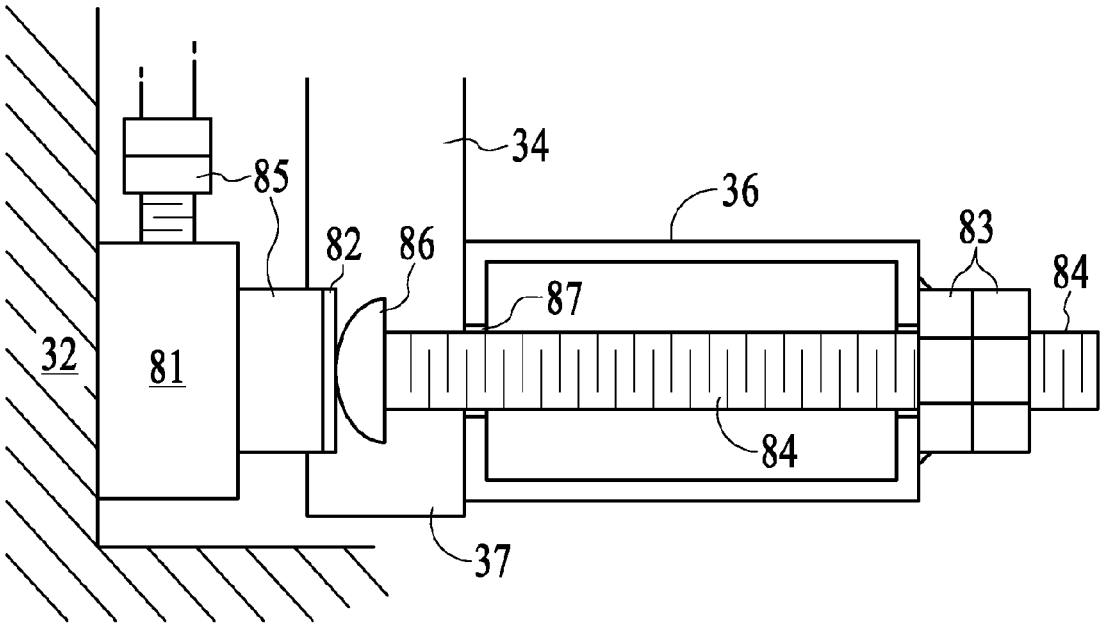
FIG. 3 is a sketch presenting a cross section view of the hydraulic actuator and an associated adjustment mechanism that pivots or tilts the cantilever bracket structure upward lifting the seated, front, (poolside) longitudinal seating structure off of the lowered bond beam structure of the adjacent pool sidewall sufficiently to allow extension and retraction travel of pool cover system elements.
Figure 6:
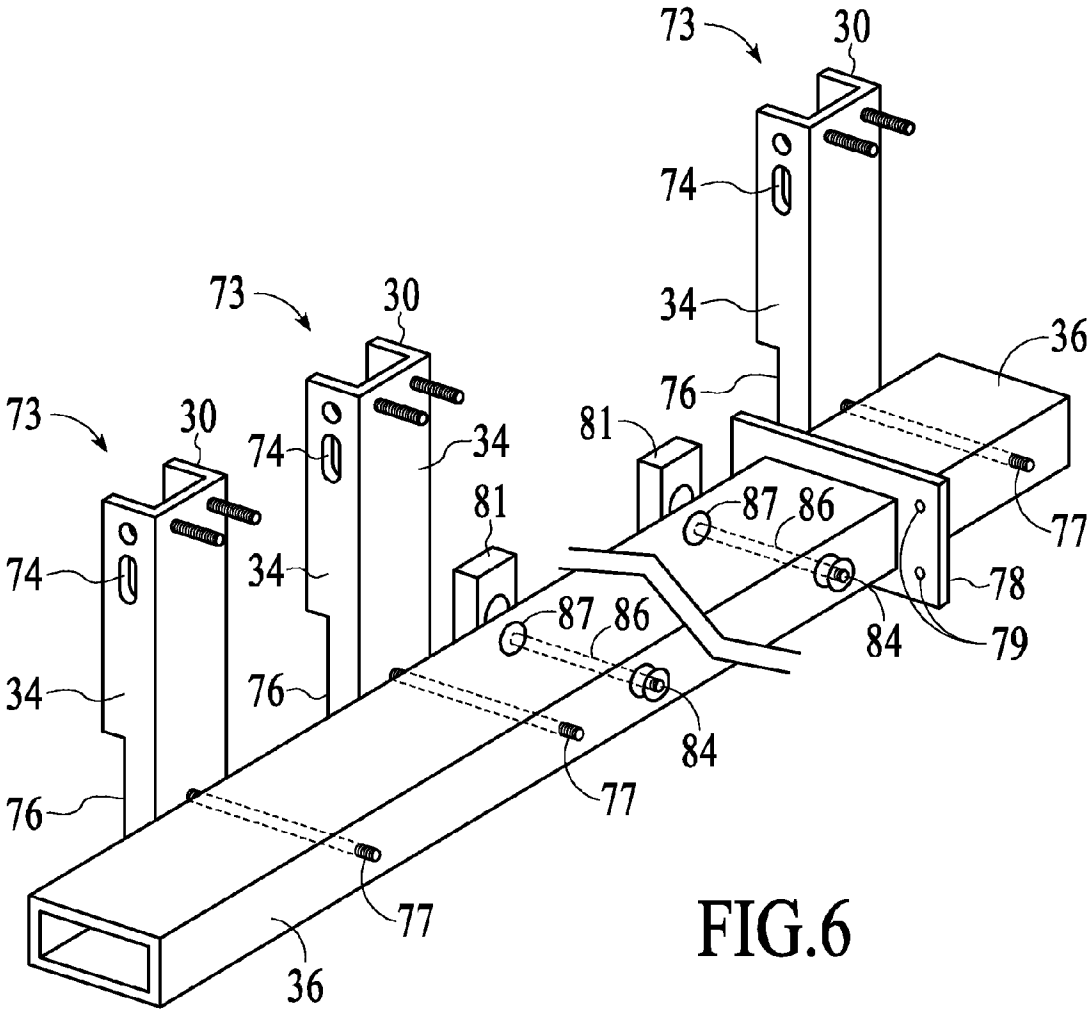
FIG. 6 is a perspective sketch illustrating mechanical coupling between the longitudinal actuator beam and extending actuator arms of the cantilever bracket structure.

Turning now to FIGS. 2 & 6 showing details of, and the actuating components allowing, and pivoting the cantilever bracket structure 31, each extending support arms 33 of the cantilever bracket structure 31 comprises a inverted flat-faced steel L-beam 71 with a conventional planer steel inside-corner reinforcement plate 72 perpendicularly welded in the corner of the L-beam, at the center line of the L-beam 71. The vertical actuator arms 34 of the cantilever bracket structure 31 each comprise conventional steel U-beams 73 with the legs of the beam at the top end 39 adapted for pivotally coupling with a hinge pin assembly 38 conventionally anchored to the top of the back wall 32 of the housing trough 11 below the pool deck 41. The foot of the inverted L-beam 71 of the extending support arm 33 is conventionally bolted to the to the outside planar base face, at the top end 39 of the U-beam 73. Care should be taken to provide both a common pivoting axis when locating and anchoring the hinge assemblies 38 on top of the back wall 32 of the housing trough 11, and adequate clearance between the modular deck-lid top plate 44 being pivoted and the pool deck 41 adjacent the back of the housing trough.

Further, pool cover systems typical include pulley systems for directing cabling along the back wall 32 of the housing trough 11 connecting between on or more cable reels housed within the trough 11 and sliders 19 carrying the leading edge beam 17 anchored to the front corners of the pool cover 14, sliding in pool cover tracks 21 along opposite pool sidewalls 18 that exit the pool cover tracks 21 at opposite ends into the housing trough 11 along the back wall 32 of the trough 11. [See Applicant's U.S. Pat. No. 4,939,798, FIG. 1, & Col. 17, 11. 37-61 and U.S. Pat. No 5,184,357, FIG. 1 & Col 2, 11. 6-17.] Also lines for hydraulically actuated pool cover components are often secured along the back wall of housing troughs 11. Accordingly, it may be necessary to provide cabling ports 74 cut through, and/or reliefs 75 cut out the legs of the U-beam 73 to accommodate cabling paths and hydraulic lines located adjacent to, and/or fastened on the back-wall 32 of the housing trough 11.

Looking at FIG. 6, an actuator box beam 36 is mechanically fastened with bolts 77 extending transversely through the beam to the outside planar base face, at the distal end 37 of each U-beam 73 vertical actuator arm 34 completing the cantilever bracket structure 31. In more detail, the actuating box beam 36 can be a single rectangular steel tube or formed from several rectangular steel, tubular sections with end flanges 78 connected together with bolts 79 that would permit easy field assembly. The actuator box beam 36, whether a single, or bolted together in sections, when bolted to the bottom ends 37 of the vertical actuator arms 34, provides, in combination with the anchored hinge pin assemblies at the top of the back wall 32 of the housing trench 11 mechanically coupled to the top ends 39 of the vertical actuator arms 34, a tiltable rigid rectilinear frame with extending support arm 33, i.e. a tiltable cantilever structure 31.

Equivalently, the adjustment assembly 83 could comprise a threaded adjustment rod or bolt 84 screwing coaxially into and out of the piston 85 of any particular single action, short thrust, hydraulic cylinder 81 that engages the opposing face/wall of the actuator box beam 36.

In particular, as described and shown in FIGS. 2, & 6, the cantilever bracket structure 31, when constructed in the field, comprises a combination of separate rigid elements, namely, the hinge pin assemblies 38 rigidly anchored to the back wall 32 of the housing trough 11, the U-beam vertical actuators 34 pivotally coupled to the fixed hinge pin assemblies 38, the actuator box beam bolted at the distal or bottom ends 37 of the vertical actuators 34, and the inverted flat L-beams 71 of extending support arms 33 bolted at the top ends 39 of the vertical actuator arms 34. The purpose of the described cantilever bracket structure 31 is a tiltable structure, that, in combination with the front longitudinal seating structure(s) 27 fastened depending at the ends 43 of support arms 33, provides rigid static support bridging between the common below-deck end wall 24 and back wall 32 the housing trough 11.

Looking at FIGS. 2 and 6, the cantilever bracket structure 31 is tilted upward by one or more single action, short thrust, hydraulic actuator cylinders 81, secured to, and resting on the back wall 32 of the trough housing 11 located such that the piston heads 82 extending from the hydraulic actuators 81 to engage adjustment assemblies 83 positioned on, and integral with the actuator box beam 36 located between one or more pairs of the vertical actuator arms 34.

In more detail, each adjustment assembly 83 includes a threaded adjustment rod or bolt 84 with a head 86 axially aligned with the head 82 of the piston 85 of a particular single action, short thrust, hydraulic actuator cylinder 81. The threaded adjustment rod/bolts 84 extend via an adjustment port 87 drilled through wall side of the box beam 36 helically screwing through a nut 87 welded on the outside wall surface of the beam 36 opposite the hydraulic actuators 81. The adjustment port ideally should have a diameter greater than both the diameter of rod/bolt head 86 and piston head 82 of the hydraulic actuator cylinder 81 to increase the range of possible adjustment. Lock nuts are screwed onto the emerging shanks of the adjustment rod/bolts 84 for setting the adjustment for each particular single action, short thrust, hydraulic actuator cylinders 81.

In particular, the object is to only 'tilt-and-hold' pool-deck lid 28 supported by the cantilever bracket structure 31 tilted upward, lifting the depending front seating structure(s) 27 off the receiving top surface 26 of the end wall 24 sufficiently to assure release and, free, unencumbered, extension and retraction travel of the pool cover and any other traveling pool cover elements that may be clamped, sandwiched or held between the front longitudinal seating structure(s) 27 of the resting pool-deck lid 28 and the underlying top surface 26 of the end wall 24. However, remember and appreciate, as with most in field constructions, spacing between the housing trough back wall 32 and the actuator box beam 36 will invariably be different at different points along the length of the actuator beam 36 despite efforts to achieve precision. Also the throws or reach of hydraulic actuators even from a common manufacturer are never precisely the same. Also it can advantageous to be able to use hydraulic actuators with different throws and from different manufacturers. The described adjustment assemblies 83 preferably are adjusted to permit full extension of each of the piston heads of the single action, hydraulic actuators 81 tilting the cantilever bracket structure 31. Full extension of hydraulically and pneumatically single action pistons within actuating cylinders increases pressure within such powered systems. If the hydraulic/pneumatic power source provides fluid pressure greater than that necessary to effect full extension of the particular, or set of such particular piston actuators, the change in pressure provides a means for holding extension of the particular or set of such particular piston actuators, e.g., those tilting the pool deck lid 28, while driving other component in the involved system requiring higher hydraulic or pneumatic pressure. Discussion and description of implementations of hydraulic/pneumatic systems using such pressure parameters for sequentially tilting the pool-deck lid 28 and extending and retracting the pool cover 14 with reversible hydraulic/pneumatic powered pool cover system are presented below.

Figure 7:
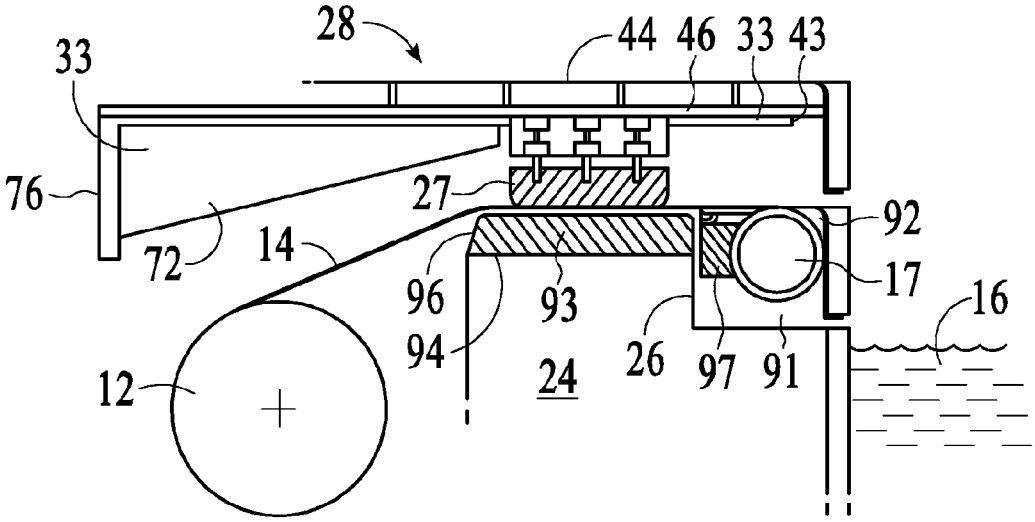
FIG. 7 is a variation of FIG. 2 with emphasis on integrating details of the top structure of the adjacent pool wall with the structure of the leading edge beam of the pool cover system when the cover is retracted.
Figure 7A:
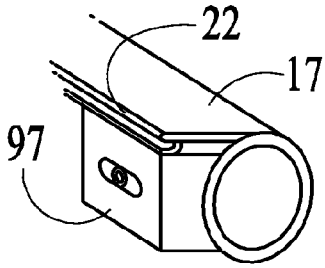

Turning now FIGS. 7-10, showing various structural features integrating the pool-deck lid 28 leading edge beam 17 with the top surface 26 of the below-deck pool end wall 24 between the pool 16 and housing trough 11, reference should first be made to Applicant's U.S. Pat. No. 4,939,798, particularly Col. 10, L. 2-Col. 11, L. 27 describing the necessary features of a structural boom or beam supported by sliders 19 for carrying the fronts of pool covers back and forth across a pool. FIGS. 7 & 7*a* show an extruded leading edge beam 17 structure as taught in U.S. Pat. No. 4,939,798 differing only in orientation. The poolside top of the end wall 24 has a rectilinear cut-out or step down volume 91 dimensioned for receiving the leading edge beam 17 and an attached right-angle fascia structure 92 integrating the appearance of the poolside front surface of the beam 17 with that of the pool walls 18 & 24 when the pool cover 14 is fully retracted. Rearward, a tailored, longitudinal, seating block 93 is mounted across, on the top step 94 of the end wall 24. The seating block 93 has a rounded, longitudinal rear wear-edge that abuts against and smoothes the undersurface of the pool cover 14 as it is wound and unwound from around the cover drum 12. The seating block 93 should be composed of an ultra-high-molecular-weight (UHMW) plastic or a dense plastic material such as polyoxymethylene (POM) that has high stiffness, low friction and excellent dimensional stability, marketed by DuPont under the Trademark Delrin®. The front longitudinal seating structure(s) 27 of the pool-deck lid 28 fastened hanging from the extending distal ends 43 of the extending support arms 33 seat directly on the tailored seating block 93 when the pool-deck lid is closed—not tilted up. The front longitudinal seating structure(s) 27 (FIGS. 4, 4*b*, 11 & 21) preferably should also be composed of a UHWM plastic material or POM that have high stiffness, low friction and excellent dimensional stability.

The leading edge beam 17 also carries bumper stops 97 fastened below the back C-channel 22 preferably at the respective ends of the beam 17. Bumpers stops 97 may also be similarly mounted at various points along the leading edge beam 17 between the ends. As shown the bumper stops 97 should extend out from the tubular beam body to just beyond the front edge of the back C-channel edge 22 of the leading edge beam 17 to prevent deformation of the C-channel due to impacts against the front top edge of the longitudinal seating block 93 that the pool cover 14 slides over as it winds and unwinds from around the cover drum 12 in the housing trough 11. Suitable bumper stops 97 should be composed of a relatively stiff, resilient inert material like silicone rubber or POM.

Figure 8:
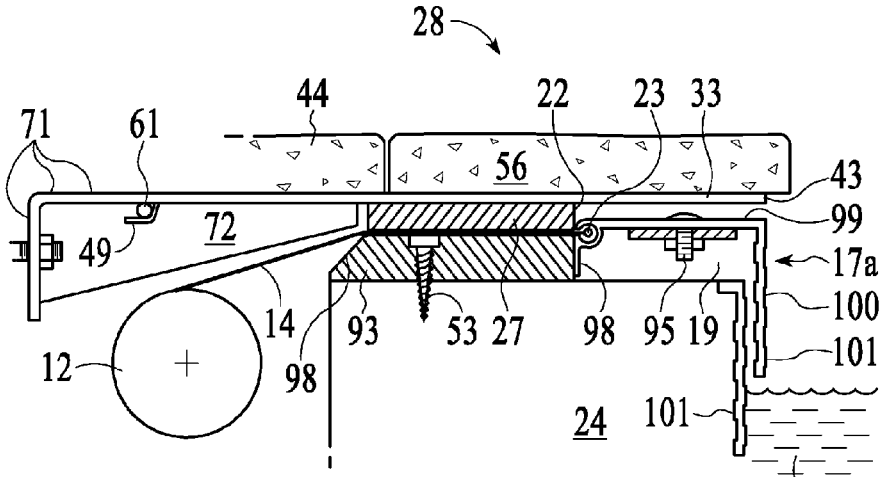
FIG. 8 presents a cross-sectional view of a novel, extruded or structural right-angle, leading-edge beam spanning across a pool supported by sliders traveling in conventional pool cover tracks mounted within or adjacent the pool sidewalls having a longitudinal extending leg with a C-channel along its edge for receiving and carrying a front, beaded edge of a pool cover back and forth across the pool and having a downward extending longitudinal vertical leg adapted to engage the poolside face of the below-deck pool wall between the pool and housing trough and the opposite end wall for positively stopping pool cover retraction and extension.
Figure 9:
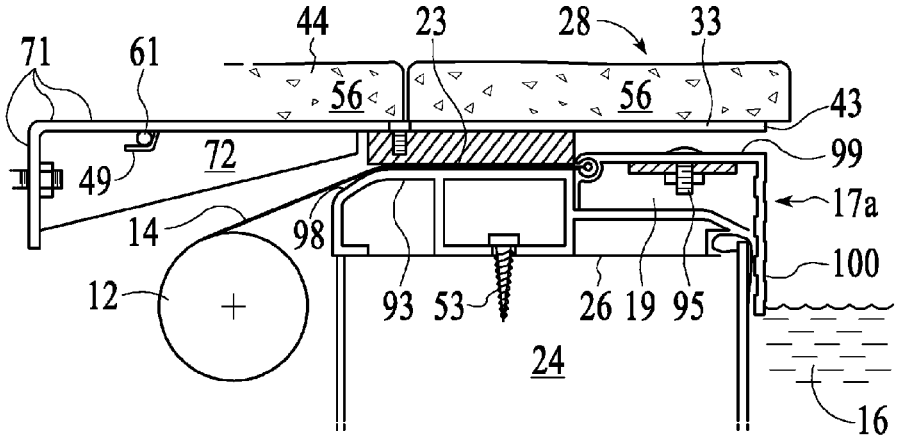
FIG. 9 illustrates a modification of the extruded or structural leading-edge beam shown in FIG. 8 for vinyl liner pools that includes a special extrusion topping the below-deck pool wall between the pool and trough housing providing a pool liner channel for receiving and securing a top edge of a vinyl pool liner.

FIGS. 8 & 9 illustrate features of a right-angle, extruded leading edge beam 17*a* with a longitudinal, rear edge C-channel 22 having a stop-land shoulder 98 extending from the base of the C-channel below the plane of the horizontal beam leg 99 of the right-angle leading edge beam 17*a*. In the embodiment shown in FIG. 8, the stop-land shoulder 98 engages or strikes the front face of the seating block 93 establishing the fully retracted position of the pool cover 12 with the horizontal leg 99*a* of the leading edge beam 17*a* extending into the rectilinear cut-out or step down volume 91 with the vertical leg 100 of the lead leading edge beam 17*a* extending down adjacent to and overlapping the poolside face of the end wall 24 below the step down volume 91. In the embodiment for vinyl liner pools shown in FIG. 9, the vertical leg 100 of the lead leading edge beam 17*a* extends down adjacent to, and overlaps and conceals a special extrusion 102 topping the below-deck end wall 24 for securing a conventional vinyl pool liner 103. The front poolside face of vertical legs 100 of such extruded right-angle leading edge beams 17*a* may also present fascia 101 integrating with the appearance of the of the pool walls 18 & 24 when the pool cover 14 is fully retracted.

Figure 10:
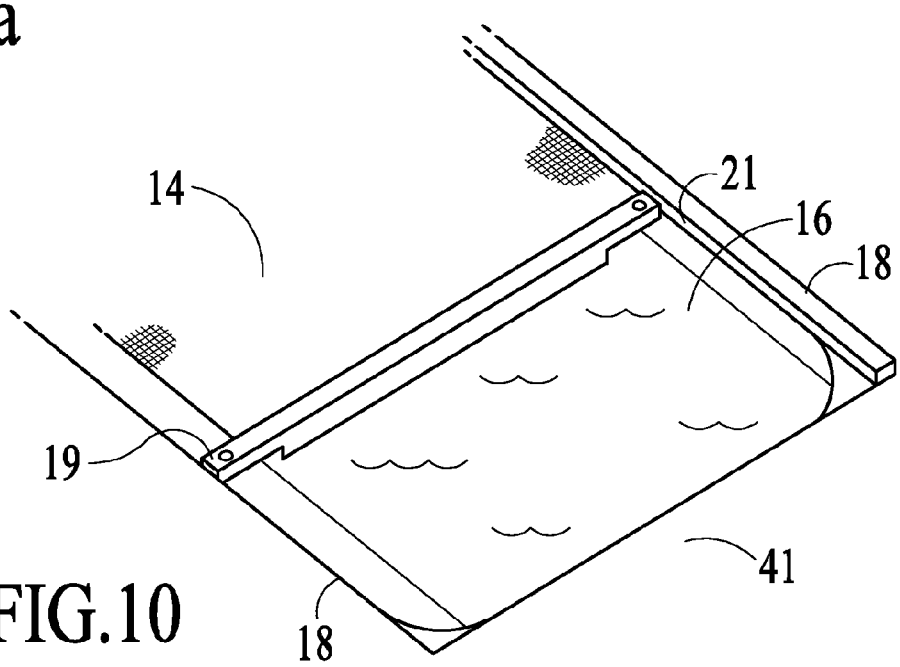
FIG. 10 illustrates the extruded or structural right-angle leading-edge beam of FIG. 8 modified to allow the leading edge beam to pass over radius corners sections at the pool ends before contacting the poolside faces at the respective end walls stopping extension and retraction of the pool cover.

Additionally, the above described right-angle, leading edge beams 17*a* eliminate the necessity for connecting plates 37 between the beam structure and the sliders 19 per the teachings of Applicant's U.S. Pat. No. 4,939,798, [See FIGS. 5 & 8]. In particular, the longitudinal, rear edge C-channel 22 and depending a stop-land shoulder 98 of the horizontal leg 99*a* and vertical leg 99*b* of the beam extrusion 17*a* can be cut away at the beam ends as shown in FIG. 10 providing extending planer plates that are easily adapted for connection to the sliders 19 with a pin or bolt 95 as taught by the Applicant in his U.S. Pat. No. 4,939,798. [See FIG. 8 and discussion at Col. 10 LL. 12-25].

Pool decks 41 vary significantly in thickness depending on the surface desired, e.g. coping stone or tile. Also pools 16, housing troughs 11 are constructed and components of pool cover systems are assembled in the field. Variations in elevation between cooperating elements of the constructed pool and housing trough, and components of the pool cover system assembled/installed in the constructed pool and housing trough will invariably occur. The thickness of the longitudinal 93 seating block mounted on top of the end wall 24 can not be easily adjusted, just changed. However, the elevation of the front seating structure(s) 27 supported depending from the support arms 33 of the cantilever bracket structure 31 can be adjusted as illustrated in FIGS. 11 and 12.

Figure 11:
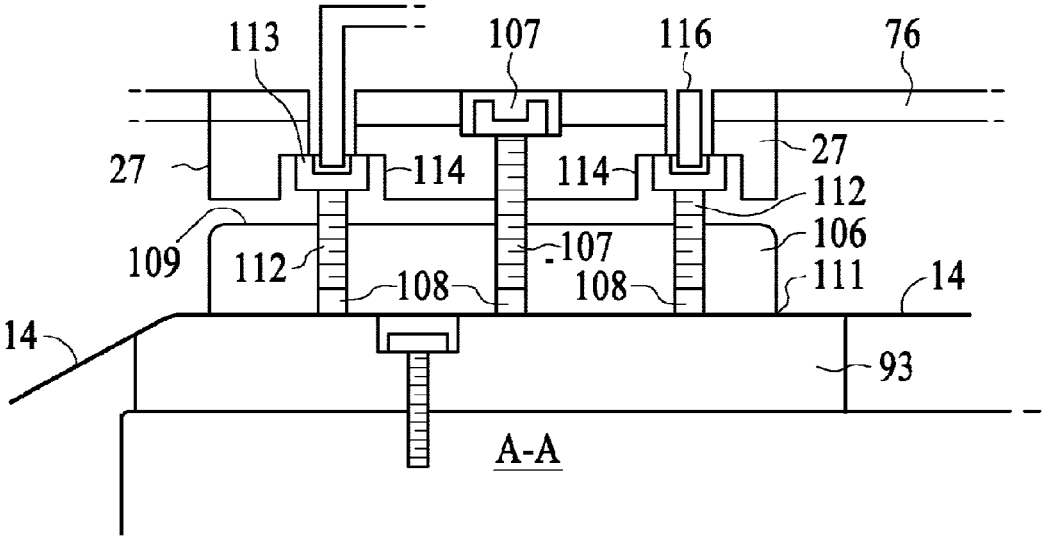
FIGS. 11 and 12 illustrate elements of an exemplary means for adjusting or shimming the elevation between front, longitudinal seating structures seated on the static, and the below-deck, beam-top structure of the pool sidewall between the pool and the housing trough for accommodating different thicknesses of typical pool decks, and for correcting elevation differences between the arms of the pool-deck lid cantilevered over the housing trough and the top of the below-deck pool wall adjacent the housing trough, as constructed and assembled to assure that the seating structures at the front ends of the arms supporting the pool-deck lid each are statically seated on the below-deck pool end wall when the pool-deck lid is closed.
Figure 12:
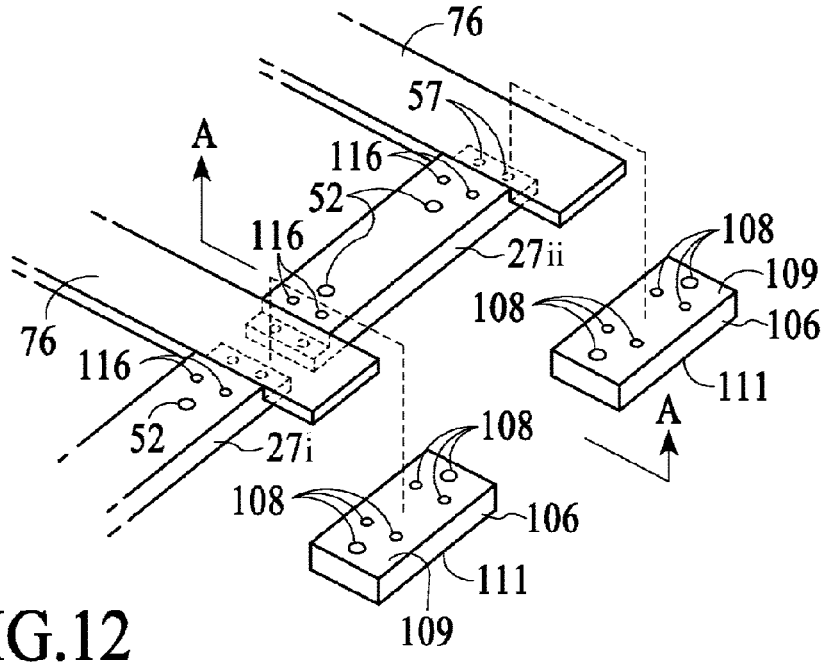

In particular, FIGS. 4, 4*b*, 5, 5*b*, 11 & 12 show front seating structure(s) 27 comprised of a plurality of longitudinally aligned hexahedral POM planks $\mathbf{27}_i$ each conventionally secured between each pair of support arms 33 to underside, near the ends of the inverted L-beams 76 of the support arms 33. FIGS. 11 and 12 show an additional plurality of adjustment or shimming blocks 106 of POM bridging over adjacent ends, and adjustably fastened to the underside of respective POM planks $\mathbf{27}_i$ & $\mathbf{27}_{ii}$ secured to each inverted L-beam 76. A shimming block 106 is securing at each end by allen head setting screws 107 countersunk through the L-beam 76 into the surfaces of the respective underlying POM planks $\mathbf{27}_i$ & $\mathbf{27}_{ii}$ received in threaded holes 108 drilled into the top surface 109 of the particular shimming block 106. The elevations and angular orientations of the bottom planar surface 111 of the respective shimming blocks 106 relative to the top of the longitudinal seating block 93 on the pool end wall 24 is adjusted with 2 pairs of adjustment allen screws 112 similarly received in threaded holes 108 drilled into the top surface 109, at each end of the particular adjustment block 106.

As illustrated the heads 113 of the adjustment allen screws 112 extend above the top surface 109 of the shimming blocks 106 and are received seated in stepped holes 114 drilled into the bottom surface 114 of the overlying POM planks $\mathbf{27}_i$ & $\mathbf{27}_{ii}$. The heads 112 of the adjustment allen screws 112 seat on the annular shoulder of the stepped holes 114. Access to the heads 112 of the adjustment allen screws 111 is afforded by drilling access ports 116 through the overlying L-beam 76. Equivalently, the stepped holes 114 receiving and seating the heads 113 of the adjustment allen screws 112 could be provided by drilling a holes completely through the overlying POM planks $\mathbf{27}_i$ & $\mathbf{27}_{ii}$ sized to receive the heads 112 of the adjustment allen screws 111 extending up from the shimming block 106 and drilling access ports 114 through the overlying L-beam 76 sized smaller than the heads 112 of the adjustment allen screws 111.

In either case, the elevation and angular orientation of the planer bottom surface 111 of the shimming block 106 can be adjusted by:

a) seating the front seating structure(s) 27 of the pool-deck lid 28 on the longitudinal seating block 93 mounted on top of the pool end wall 24;

b) removing one or more of the overlying deck-lid top plates 44 from the support arms 33;

c) loosening or removing the allen head setting screws 107 countersunk through a particular L-beam 76 into the surface of underlying adjacent POM planks $\mathbf{27}_i$ & $\mathbf{27}_{ii}$, securing a selected shimming blocks 106;

d) adjusting the elevation of each corner of the selected shimming block 106 with the adjustment allen screws 111 such that each corner of the shimming block 106 to just engages the surface of the longitudinal seating block 93 mounted on top of the pool end wall 24 for orienting bottom planar surface 111 of the shimming block 106 to the planer orientation of the top of the seating block 93;

e) conforming elevation of each inverted L-beam of each pair of support arms 33 supporting a front seating structure 27 by simultaneously adjustment of one or more of the pairs of adjustments screws at the respective ends of the respective shimming blocks 106 via access ports;

f) inserting and/or tightening the allen head setting screws 107 securing the selected shimming block 106 at the particular conforming elevations and bottom surface orientations.

Hydraulic/Pneumatic Systems

It is well recognized by engineers and designers that designs for hydraulic or pneumatic actuation systems typically have hydraulic or pneumatic components are equivalent in that components in pneumatic systems will perform substantially the same functions, in substantially the same ways to achieve substantially the same results as the hydraulic counterparts of those components in hydraulic systems with essential one fundamental difference. Hydraulic fluid is liquid thus incompressible, while pneumatic fluids are gas thus compressible. In context of the Applicant's present AUTOMATED POOL-DECK LID LIFT SYSTEM FOR BELOW DECK POOL COVER HOUSING TROUGHS, hydraulic actuations systems are preferred because the force driving and supporting actuated components is static in a liquid full system, whereas in a comparable pneumatic system, the force driving and supporting components is not, but rather is a function varying with load and system volume. Accordingly, the schematically actuation control schemes of FIGS. 1*a*, 1*b*, 1*c*, & 1*d* for synchronizing raising and closing the pool-deck-lid 28 with hydraulically actuated pool cover systems for extending and retracting a pool cover 14 back and forth across a pool 16.

FIG. 1*a* schematically illustrates a dual, reversible hydraulic motor system described in Applicant's U.S. Pat. Nos. 5,184,357, 5,327,590 and his pending patent application published at US2008/0178587. The reversible hydraulic motors 12*m* and 13*m* respectively power and resist rotation of the cover drum 12 and the cable reel(s) 13 as indicated by lines connecting to the cover drum 12 and cable reel(s) 13. As indicated, the reversible hydraulic motors 12*m* and 13*m* and associated anti-cavitation manifold 121 are housed in the housing trough 11 with the hydraulic actuator cylinders 81 tilting the pool-deck lid 28 covering the housing trough 11. The hydraulic power source (a pump) 122, the associated fluid reservoir 123, a momentary electrical control 132, a directional control valve 124, pressure sequencing valves 126 and 127 are each remotely located, not in the housing trough but rather at a power pack location and control station. Hydraulic lines 128, 129, and 131 respective connect between the remote hydraulic power source 122 and the motors 12*m*, 13*m*, powering the cover drum 12 and cable reel(s) and hydraulic actuator cylinders 81 tilting the pool-deck lid 28.

To retract the pool cover 14 from across the pool, a normally open momentary electrical control switch 132 that activates at either a left or right position is activated left and held (see arrows at 132) turning on the hydraulic power source (pump) 122, and shifts directional control valve 124 left 122 via electrical lines 134 and 135 connecting between the control station and the power pack locations for simultaneously supplying fluid and pressure to the single acting hydraulic cylinders 81 via hydraulic line 131 for tilting the pool-deck lid 28 up, and to reversible hydraulic motor 12*m* via hydraulic line 129 through power sequence valve 126 that blocks flow temporarily until a preset pressure level is reached. Accordingly the actuating pistons 85 of the single acting hydraulic cylinders 81 fully extend tilting the pool-deck lid 28 upward lifting its depending front seating structure(s) 27 off the receiving top surface 26 of the pool end wall 24 sufficiently to assure release and free, unencumbered, retraction travel of the pool cover before reversible hydraulic motor 12*m* is actuated.

Upon full extension of the actuating pistons 85 of the single acting hydraulic cylinders 81 there is a consequent increase of pressure within the hydraulic system. At the preset pressure, power sequence valve 126 releases allowing fluid flow and pressure to actuate (drive) reversible hydraulic motor 12*m* for rotating the cover drum 12 winding up the pool cover 14 retracting it and the leading edge beam 17 from across, uncovering the pool.

For extension of the pool cover 14, the momentary electrical control switching 132 is held at the right position turning on the hydraulic power source (pump) 122 and shifts directional control valve 124 left via electrical lines 134 & 135 for simultaneously supplying fluid and pressure to the single acting hydraulic cylinders 81 via hydraulic line 131 again for tilting the pool-deck lid 28 up, and then to reversible hydraulic motor 13*m* via hydraulic line 130 through power sequence valve 127 that blocks flow temporarily until the preset pressure level is reached, allowing the single acting hydraulic cylinders 81 to first, fully tilt the pool-deck lid 28 back up lifting its depending front seating structure(s) 27 off the receiving top surface 26 of the pool end wall 24 sufficiently to assure release and free, unencumbered, extension travel of the pool cover 14 across the pool 16. Upon full extension of the actuating pistons 85 of the single acting hydraulic cylinders 81 there is again a consequent increase of pressure within hydraulic the hydraulic system. At the preset pressure, power sequence valve 127 releases and fluid flow and pressure for actuating and driving reversible hydraulic motor 13*m* rotating the cable reel(s) unwinding the pool cover 14 from around the cover drum 12 extending the cover and the leading edge beam 17 back across the pool 16 to, the opposite end wall covering the pool 16.

Release of the momentary electrical control switch 132 held at either the left or right position, cuts electrical power to the hydraulic power source (pump) 122 turning it off, and to the directional control valve 124 which returns to its normally center position permitting fluid flow from actuated components of system to the fluid reservoir 123 via hydraulic lines 129, 130 and 131. Accordingly, the fluid in actuated ingle acting hydraulic cylinders 81 statically resisting the force of gravity and mass (weight) of the tilted pool-deck lid 28 is drains to reservoir 123 from the hydraulic cylinders 81 and the actuating pistons 85 sink back into the hydraulic cylinders 81 at a rate determined the flow rates allowed by hydraulic line 131 connecting through the directional control valve 124 to reservoir 133. As the hydraulic fluid exhausts from the hydraulic cylinders 81, the pool-deck lid 28 gradually tilts back to a down position where the front longitudinal seating structures 27 seats on the pool cover 14 and the underlying longitudinal seating block 93 on top of the pool end wall 24. In the down position, the pool-deck lid 28 statically rests solidly on the pool end wall 24 and the hinge pin assemblies anchored on the back wall 32 of the housing trough 11. The pool cover 15, whether at the fully retracted position, or at the fully extended position, or anywhere in between is clamped, sandwiched between seating block 27 on top of the pool end wall 24 and the depending poolside front longitudinal seating structures(s) 27 of the pool-deck lid 28 statically resting solidly on that end wall 24.

Normally open, momentary, control switching systems, whether electrical, hydraulic pneumatic, or a combination thereof for activating and interrupting extension and retraction of powered pool cover systems is a prescribed best pool safety practice that requires an observing human presence for manually initiating, and for controlling extension and retraction travel of a pool cover over a pool.

FIG. 1(*b*) is a schematic of a dual, reversible hydraulic motor system described in Applicant's U.S. Pat. Nos. 5,184,357, 5,327,590 and his pending patent application published at US2008/0178587 with a shuttle valve 136 located in the housing trough 11 that eliminates the hydraulic line 131 connecting between the remote power pack location and the hydraulic actuator cylinders 81. Upon pressurizing either line 129 or 130, either line 138 or line 139 connecting to shuttle valve 136 are respectively pressurized, shifting the shuttle ball 137 respectively to the right or left to block flow to the right or left side of the hydraulic circuit energizing the reversible hydraulic motors 12*m* & 13*m*, but allows flow to line 8 to actuate the cylinder 20. Sequence valve 11 does not allow flow to the pool cover drive motor 15 until the cylinder 20 reaches full extension and causes the system pressure to rise to the preset point where flow is allowed to the pool cover drive motor 15.

FIG. 1(*c*) schematically presents a hydraulic system essentially the same as that show in FIG. 1(*b*) except a reversible power pack is used instead of a directional control valve. The reversible power pack includes a reversible hydraulic pump 141 with pressure with relief valves 141*a* & 141*b* for relieving pressure in the respective legs above a set point, and is equipped with a dual coupled check valve mechanism 142 as described in Applicant's U.S. Pat. No. 7,155,910 to allow low pressure return fluid flow to reservoir 123. In this system by the normally open, momentary, electrical control switch 124 directs electrical power to controlling the direction of reversible pump 141 and cuts power off to the pump upon returning to the open middle position allowing the hydraulic fluid to drain to reservoir 123.

FIG. 1(*d*) is schematic illustrating the elements of a suitable hydraulic system powered by a single reversible hydraulic pool cover drive motor 146 coupled to a reversing clutch device 147 as described in U.S. Pat. No. 5,913,613, Ragsdale et al, for alternatively rotating the cover drum 12 or the cable reel(s) 13 for retracting and extending the pool cover 14. As with the dual, reversible hydraulic motor systems described above, flow of pressurized hydraulic fluid is initially directed by one or the other the pressure sequencing valves 126 and 127 to the hydraulic actuators 81 tilting the deck lid up that then open at a preset pressure to directing the higher pressure hydraulically fluid to appropriately drive the reversible hydraulic motor 146 for rotating the cover drum 12 or the cable reel(s) 13 for retracting or extending the pool cover 14 back and forth across the pool 16.

In each the hydraulic system schematically illustrated in FIGS. 1*a*, 1*b*, 1*c*, & 1*d*, once powered by pumped hydraulic fluid each system pressurizes and fully extends and holds the pistons 85 in the set of single action hydraulic actuator cylinders 81 tilting and statically holding the pool-deck lid tilted-up until hydraulic power (pumped hydraulic fluid) is interrupted, and then allows gravity and the mass of the pool deck lid 28 to force (push) the pistons 85 back into the respective cylinders forcing flow of hydraulic fluid from the hydraulic actuator cylinders 81 to reservoir 123.

From the above discussion, it should be further noted that each schematically illustrated hydraulic system is designed to power or drive a complete actuating action of first set of actuator components from a resting state to an actuated state at a first low pressure, then to power or drive a second set of actuator components at a higher pressure in the system induced by the completion of the actuating action of first set of actuator components, where the induced higher pressure holds or maintains the first set of actuator components at the actuated state action until the system is turned off, allowing the first set of actuator components to return to a resting state responsive to an external force. In this context, a hydraulic designer should consider, that in specifying components for hydraulic system for sequentially supporting, opening and closing a pool-deck lid covering below-deck troughs housing coordinated with operation of a powered pool cover system as described herein to:

1. the approximate weight (mass) of a proposed pool-deck lid structure and possible one or more people standing on the pool-deck lid structure over the blow-deck housing trough proposed to be lifted or tilted;

2. the number and lifting of single action hydraulic actuator cylinders required for lifting or tilting that approximate mass at a low pressure, e.g. 400-500 psi, below that at which hydraulic pool cover system normally operate (70-1500 psi);
3. the rate of extension, the support capacity, and the piston extension required of the actuating cylinders necessary to smoothly and sufficiently lift, or tilt and hold the lid in the above the supporting wall between the pool and housing trough without excessive jarring; and
4. the rate of piston return into the hydraulic cylinders and capacity of the hydraulic lines draining hydraulic fluid from the cylinders back to reservoir on termination of hydraulic power The designer should also note appreciate that the pistons of the hydraulic actuator cylinders may not completely or be equally retracted into the respective cylinders the pool-deck lid descends or tilts back into to rest is front edge on the below deck pool end wall between the pool and the trough housing, thus, the necessity for adjustment assembly 83 as discussed above.

The invention claimed is:

1. A pool-deck lid lift system for below-deck troughs housing pool cover systems for pools, comprising in combination:

(i) a pool-deck lid with removable modular deck-lid top plates bridging over a below-deck tough housing, having a front, longitudinal seating structure adapted to rest on pool cover elements of a pool cover system, statically supported on top of a below-deck pool sidewall beneath a pool cover element located between the pool and the below-deck housing trough over which the pool cover elements extend from, and retract back into the below-deck housing for covering and uncovering the pool;

(ii) an upwardly movable, cantilever bracket structure secured along a longitudinal back wall of the housing trough having a plurality of extending support arms extending across the trough for supporting the longitudinal lid seating structure and the modular deck-lid top plates, and having a plurality of actuator arms extending vertically downward adjacent the back wall of the housing trough, all fastened to a common longitudinal actuator beam;

(iii) hydraulic/pneumatic means mechanically coupled between the common longitudinal actuator beam of the cantilever bracket structure and a solid, static inside surface of the housing trough for lifting the front longitudinal seating structure of the pool-deck lid up off the pool cover element between the longitudinal seating structure and the supporting top of the below-deck pool sidewall beneath the pool cover element to allow extension and retraction of the pool cover elements covering and uncovering the pool; and (iv) a hydraulic/pneumatic actuation control means for powering the deck-lid system and the pool cover system housed in the below-deck housing trough, coupled for sequentially:

a. lifting the front, longitudinal seating structure of the pool-deck lid up off the travelling pool cover element between the front longitudinal seating structure and the supporting top of the supporting below-deck pool sidewall beneath the pool cover element, then b. energizing the pool cover system for extending and retracting the pool cover elements covering and uncovering the pool; then c. stopping extension and retraction of the pool cover elements between, and at extension and retraction end points, and d. allowing the lifted front longitudinal seating structure of the deck-lid supported by the cantilever bracket structure of the pool-deck lid lift system to re-seat on the pool cover element and the top of the below-deck pool sidewall beneath the pool cover element for support after travel of the pool cover elements has been stopped.

2. The pool-deck lid lift system of claim 1 wherein the cantilever bracket structure tilts upward, for lifting the front, longitudinal seating structure off of the top of the below-deck pool sidewall beneath the pool cover elements between the pool and the housing trough and includes:

a) a plurality hinge pin assemblies rigidly anchored to the back wall of the housing trough, b) an U-beam vertical actuator arm pivotally coupled to the anchored hinge pin assemblies, c) an actuator box beam bolted at the distal or bottom ends of the vertical actuators, d) an inverted flat L-beam providing extending support arms bolted at the top ends of each vertical actuator arm, providing a structurally rigid, tilting structure, that, in combination with the front longitudinal seating structure fastened, depending at ends of support arms, provides rigid static support, when solidly seated for support on top of the below-deck pool sidewall beneath the travelling pool cover elements bridging over the housing trough between the below-deck pool sidewall and back wall of the housing trough.

3. The pool-deck lid lift system of claim 2 wherein the front longitudinal seating structure fastened, depending at ends of support arms includes:

e) a plurality of longitudinally aligned hexahedral UHMW plastic planks ($P_n$) each conventionally secured underneath and between each pair of support arms near the ends of the inverted L-beams of the support arms, f) plurality of adjustment or shimming blocks of UHMW plastic bridging over adjacent ends, and adjustably fastened to the underside of respective pairs of UHMW plastic planks ($P_1$ & $P_2$) secured to each inverted L-beam at each end by allen head setting screws countersunk through the L-beam into underlying surfaces of the respective UHMW plastic planks ($P_1$ & $P_2$) received in threaded holes drilled into the top surface of the particular shimming block, and g) means for adjusting elevations and angular orientations of bottom planar surfaces of the respective shimming blocks relative to the top of a longitudinal seating block on top of the pool end wall.

4. The pool-deck lid lift system of claim 3 wherein the means for adjusting elevations and angular orientations of bottom planar surfaces of the respective shimming blocks comprises, in combination:

h) two pairs of adjustment allen screws similarly received in spaced apart threaded holes drilled into, at each end of the particular adjustment block extending up from the top surface, having flat, circular heads of a particular size;

j) step holes stepped in diameter drilled into bottom surfaces through the overlying UHMW planks ($P_1$ & $P_2$) each having a larger diameter bottom section sized for receiving heads of the adjustment allen screws and a smaller diameter top section sized for providing turning access to the top of the head of the adjustment allen screws located for receiving the adjustment allen screws extending up from the top surface of the particular adjustment block, k) access ports drilling through the overlying L-beam sized smaller than the heads of the adjustment allen screws registering with the step holes stepped in diameter drilled into bottom surfaces 114 through the underlying respective pairs of UHMW planks ($P_1$ & $P_2$), whereby the bottom surfaces bottom planar surfaces of the respective shimming blocks can be angularly oriented in space by turning each of the four adjustment allen screws adjusting the elevation of each head of the four the adjustment allen screws above the top surface of the shimming block, and the elevation of the bottom surfaces bottom planar surfaces of the respective shimming blocks can be adjusted relative to the top of the longitudinal seating block on top of the pool sidewall 24 by simultaneous turning of each pair of adjustment screws at each end of the particular shimming block, and then m) seating and setting the angular orientations and elevations of the respective shimming blocks 106 by turning the allen head setting screws countersunk through the L-beam for seating and securing the heads of the adjustment allen screws on annular steps of the step holes drilled through the overlying respective pairs of UHMW planks ($P_1$ & $P_2$) defined at the juncture of the larger sizes and smaller size sections of the stepped holes.

5. The pool-deck lid lift system of claim 1 wherein the hydraulic/pneumatic actuation control means for powering the deck-lid system and the pool cover system housed in the below-deck housing trough includes:

(i) dual reversible hydraulic motors ($M_1$ & $M_2$) and an anti-cavitation manifold coupled for alternatively rotating gin a cover drum and cable reels for extending and retracting pool cover elements of the pool cover system and hydraulic actuator cylinders mechanically coupled for lifting the front, longitudinal seating structure of the pool deck-deck lid covering the housing trough, supported on top of the below-deck pool sidewall beneath the pool cover elements, all housed in the housing trough, (ii) a hydraulic power source remotely located at a power pack location, (iii) a fluid reservoir remotely located at the power pack location, (iv) a directional control valve located at the power pack location, (v) two pressure sequencing valves ($V_1$ & $V_2$) located in the housing trough hydraulically closed at pressures below a pre-determined threshold pressure ($P_T$) and hydraulically open at a pressures above the predetermined threshold pressure ($P_T$), (vi) a normally off, momentary electrical control located at a control station, (vii) hydraulic lines respectively connecting between the motors ($M_1$ & $M_2$), respectively though the pressure sequencing valves ($V_1$ & $V_2$) to the hydraulic power source powering rotation of the cover drum and cable reel(s) and extension of hydraulic actuator cylinder pistons for lifting the front, longitudinal seating structure of the pool-deck lid off the travelling pool cover element between the front longitudinal seating structure and the supporting top of the below-deck pool sidewall beneath the pool cover element up freeing the pool cover element move allowing extension and retraction of the pool cover elements, (viii) a shuttle valve ($V_s$) having an open port, located in the housing trough for alternatively, hydraulically linking either hydraulic line to its open port serially connected between the remote hydraulic power source and the pressure sequencing valves ($V_1$ & $V_2$) and (ix) a hydraulic line 131 connecting between the open port of the shuttle valve ($V_s$) and the hydraulic actuator cylinders for lifting the front longitudinal seating structure of the pool-deck lid off any elements of the pool cover and the underlying supporting top of the below-deck pool side wall beneath the element of the pool cover at a hydraulic pressure less than the predetermined threshold pressure ($P_T$).

6. The pool deck lift system of claim 1 wherein the hydraulic/pneumatic means comprises at least one single action, short thrust, hydraulic cylinder mechanically coupled between the common longitudinal actuator beam of the cantilever bracket structure and a solid static inside surface of the housing trough for raising the statically seated, longitudinal seating structure off the top of the below-deck pool sidewall beneath the pool cover element having a piston head located for engaging an opposing planer face of the of the longitudinal actuator beam of the upwardly movably, cantilever bracket structure for raising, the seated, longitudinal seating structure slightly up off the top of the below-deck pool sidewall at full extension of each piston at an initial pressure ($P_1$); and further including means for adjusting elevation the longitudinal seating structure is raised up off the top of the below-deck pool sidewall upon full extension of each piston head of the single action, short thrust hydraulic cylinder(s);

wherein the hydraulic actuation control means for powering the deck-lid system and the pool cover system comprises in combination therewith:

(i) reversible hydraulic motors means located in the housing trough coupled for rotating a cover drum and cable reels for extending and retracting the pool cover elements back and forth across the pool;

(ii) a liquid reservoir remotely located at a power pack location;

(iii) an electric hydraulic pump remotely located at a power pack location for pumping output hydraulic liquid from the reservoir at a subsequent pressure ($P_2$) where $P_2$ is greater than $P_1$;

(iv) a normally neutral, directional control valve hydraulically located at the power pack location, downstream from the hydraulic pump that drains to reservoir at a neutral position and directs pressurized hydraulic liquid to the single action, short thrust, hydraulic cylinder(s) and the reversible hydraulic motors means at a retraction position and an extension position;

(v) a normally off, momentary, manual control switch remotely located at a control station for simultaneously turning on the hydraulic pump and switching the directional control valve from the neutral position, alternatively either to the retraction position or to the extension position;

(vi) pressure sequencing valves ($V_1$ and $V_2$) in the housing trough hydraulically coupling between the directional control valve and the reversible hydraulic motors for directing output hydraulic liquid at subsequent pressure ($P_2$) to the reversible motors means for powering rotation of the cover drum at the retraction position for retracting the pool cover elements from across uncovering the pool, and for powering rotation of the cable reel(s) at an extension position for extending the pool cover elements across covering the pool;

(vii) a shuttle valve having an open port, located in the housing trough for hydraulically directing pressurized hydraulic output from the electric hydraulic pump alternatively directed to the pressure sequencing valves ($V_1$) and the pressure sequencing ($V_2$) by the normally neutral, directional control valve at the retraction position and the extension position;

(viii) a hydraulic line hydraulically coupling between the open port of the shuttle valve and the hydraulic actuator cylinder(s) for tilting/lifting the pool-deck lid;

whereby, upon switching on the hydraulic pump, and switching the directional control valve from the normally neutral position either to the retraction position or the extension position, using the momentary, normally off, manual, control switch, the hydraulic pump supplies hydraulic liquid at a pressure up to $P_1$ solely to the single action, short thrust hydraulic cylinder raising the seated, front longitudinal seating structure of the pool-deck lid up, off the pool cover element and the top of the supporting below-deck pool sidewall beneath the pool cover element; and, upon each piston head reaching full extension at the pressure $P_1$, hydraulic liquid pressure output supplied by the hydraulic pump increases to $P_2$ whereupon either pressure sequencing valve ($V_2$) or pressure sequencing valve ($V_2$) directs hydraulic liquid to the reversible hydraulic motors means located in the housing trough couple for rotating the cover drum or cable reels for extending or retracting the pool cover elements from or across the pool, and upon releasing the momentary, normally off, manual, control switching off the hydraulic pump, returning the normally neutral, directional control valve to the neutral position allows hydraulic liquid in the single action, short thrust hydraulic cylinder(s) to drain to reservoir responsive to gravitational force whereupon the lifted, front, longitudinal lid seating structure of the pool-deck lid, supported by the cantilever bracket structure, descends and statically re-seats back onto a pool cover element and the top of the below-deck pool sidewall beneath that pool cover element for support.

7. The pool deck lift system of claim 6 wherein the means for adjusting elevation the longitudinal seating structure is raised up off the top of the below-deck pool sidewall upon full extension of each piston head of the single action, short thrust hydraulic cylinder(s) comprises in combination;

(ix) a threaded adjustment rod with a head axially aligned with each piston head of the single action, short thrust, hydraulic cylinder(s) helically screwing into and out of a threaded port through an opposing planer face of the longitudinal actuator beam, and (x) a lock nut screwing on each adjustment rod for locking the position of the head of each adjustment rod relative to each piston head of the single action, short thrust, hydraulic cylinder(s) for setting a particular elevation the longitudinal seating structure is lifted up off the top of the below-deck pool sidewall upon full extension of each piston in the single action, short thrust, hydraulic cylinder(s).

8. The pool deck lift system of claim 6 wherein the means for adjusting elevation the longitudinal seating structure is lifted up off the top of the below-deck pool sidewall upon full extension of each piston head of the single action, short thrust hydraulic cylinder(s) comprises in combination;

(x) a threaded adjustment rod with a head axially coaxially screwing into and out of the piston head of the single action, short thrust, hydraulic cylinder(s), and (ix) a lock nut screwing on each adjustment rod for locking a position of the head of each adjustment rod relative to the opposing planer face of the actuator beam of the upwardly movably, cantilever bracket structure for setting a particular elevation the longitudinal seating structure is raised up off the top of the below-deck pool sidewall upon full extension of each piston in the single action, short thrust, hydraulic cylinder(s).

9. The pool deck lift system of claim 6 wherein the removable, modular deck-lid top plates have a particular thickness, and the elevation the longitudinal seating structure is raised up off the top of the below-deck pool sidewall upon full extension of each piston head of the single action, short thrust hydraulic cylinder(s) is less than the thickness of the deck-lid top plates such that bottom surfaces of the modular deck-lid top plates always remain below top surfaces of a pool deck surface surrounding the below deck trough housing upon full extension of each piston of the single action, short thrust, hydraulic cylinder(s).

* * * * *